US006554076B2

(12) United States Patent
Guillory et al.

(10) Patent No.: US 6,554,076 B2
(45) Date of Patent: Apr. 29, 2003

(54) HYDRAULICALLY ACTIVATED SELECTIVE CIRCULATING/REVERSE CIRCULATING PACKER ASSEMBLY

(75) Inventors: Brett Guillory, The Woodlands, TX (US); Chris Cuffe, The Woodland, TX (US); Mike Betik, Tomball, TX (US); Mike Dion, Houston, TX (US); Ken Whanger, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 09/784,650

(22) Filed: Feb. 15, 2001

(65) Prior Publication Data

US 2002/0117309 A1 Aug. 29, 2002

(51) Int. Cl.[7] ..... E21B 33/12; E21B 33/128; E21B 34/12

(52) U.S. Cl. ..... 166/387; 166/125; 166/320; 166/386

(58) Field of Search ..... 166/120, 125, 166/131, 184, 320, 386, 387

(56) References Cited

U.S. PATENT DOCUMENTS

| | | | | |
|---|---|---|---|---|
| 2,315,921 A | 4/1943 | Baker | 166/12 |
| 2,638,168 A | 5/1953 | Parks | 166/12 |
| 2,815,817 A | 12/1957 | Conrad | 166/187 |
| 3,503,445 A | 3/1970 | Cochrum et al. | 166/244 |
| 4,018,274 A | 4/1977 | Cochran | 166/129 |
| 4,378,051 A | 3/1983 | Cholet et al. | 166/383 |
| 4,754,814 A | 7/1988 | Jordan, Jr. | 166/387 |
| 4,949,792 A | 8/1990 | Rubbo et al. | 166/382 |
| 5,082,062 A | 1/1992 | Wood et al. | 166/382 |
| 5,180,010 A | 1/1993 | Stout et al. | 166/212 |
| 5,368,098 A | 11/1994 | Blizzard, Jr. et al. | 166/100 |
| 5,396,953 A | 3/1995 | Holder et al. | 166/129 |
| 5,553,667 A | 9/1996 | Budde et al. | 166/70 |
| 5,615,741 A | 4/1997 | Coronado | 166/387 |
| 5,692,564 A | 12/1997 | Brooks | 166/127 |
| 6,148,664 A | 11/2000 | Baird | 73/152.38 |

FOREIGN PATENT DOCUMENTS

| | | | |
|---|---|---|---|
| EP | 0 618 343 A2 | 10/1994 | E21B/33/127 |
| WO | WO 98/36152 | 8/1998 | E21B/33/127 |

OTHER PUBLICATIONS

PCT Partial International Search Report from International Application PCT/GB02/00472, Dated Jul. 17, 2002.
PCT International Search Report, International Application No. PCT/GB 02/00472, dated Sep. 12, 2002.

*Primary Examiner*—David Bagnell
*Assistant Examiner*—Brian Halford
(74) *Attorney, Agent, or Firm*—Moser, Patterson & Sheridan, L.L.P.

(57) ABSTRACT

The present invention relates to packers adapted to seal an annular space within a wellbore. The packers, for example, may be utilized to circulate or reverse circulate a fluid. In one embodiment, the present apparatus comprises a first tubular subunit and a second tubular subunit moveably coupled together, a flexible packing element disposed between the first tubular subunit and the second tubular subunit, and a temporary mechanical connection adapted to restrain the first tubular subunit and the second tubular subunit from compressing the flexible packing element, in which the temporary mechanical connection is adapted to be hydraulically disengaged. In another embodiment, the present apparatus further comprises a valve. The valve may be selectively opened to allow fluid to flow between the annular space and the central bore of the valve.

44 Claims, 5 Drawing Sheets

HYDRAULICALLY ACTIVATED SELECTIVE CIRCULATING/REVERSE CIRCULATING PACKER ASSEMBLY

BACKGROUND OF THE INVENTION

1. Field of the Invention

The present invention relates to downhole packers. More particularly, the present invention relates to packers adapted to seal an annular space within a wellbore. The packers, for example, may be utilized to circulate or reverse circulate a fluid.

2. Background of the Related Art

In certain downhole applications utilizing a fluid (i.e. fluid, viscous fluid, cementation slurries, sand slurries, and acids), there is fluid remaining in the tubing string when the application is completed. Since the tubing string may be thousands of feet long, it is undesirable to pull the tubing string out of the hole with the fluids remaining in the tubing string. When pulling a "wet" tubing string, the contents of the tubing string are unmanageably dumped and released at the top of the oil platform when disconnecting the tubing. It is also undesirable to open a valve at the bottom of the tubing string to release the fluid contained in the tubing string down into the wellbore. The fluid may comprise a cement slurry which if released down into the wellbore will eventually harden and solidify. Therefore, there is a need for an improved tool adapted to circulate or reverse circulate a fluid out of the tubing while not allowing the fluid to fall to the bottom of the wellbore.

Current packers are unsatisfactory to circulate or reverse circulate fluid out of the casing. Packers are typically used to seal an annular space formed between two tubular surfaces. A packer may seal, for example, an annular space formed between production tubing disposed within wellbore casing. Alternatively, a packer may seal an annular space between the outside of a tubular and an unlined wellbore. Common uses of packers include protection of casing from pressure (including both well and stimulation pressures) and corrosive fluids; isolation of casing leaks, squeezed perforations, or multiple producing intervals; and holding of treating fluids or kill fluids.

Packers typically are either permanently set or retrievable from a wellbore. Permanent set packers are installed in the wellbore with mechanical compression setting tools, fluid pressure devices, inflatable charges, or with cement or other materials pumped into an inflatable seal element. Retrievable packers have a means for setting and then deactivating a sealing element, thereby permitting the device to be pulled back out of the wellbore.

Typical retrievable packers are weight-set packers which require the rotation of the tubing and movement of the tubing up and down to activate a "J" slot device. One problem with utilizing current weight-set packers is that it is difficult to rotate long lengths of tubing. Another problem is utilizing a weight-set packer in conjunction with coil tubing. Coiled tubing is a continuous flexible string of metal tubing which is brought to the well site on a large reel. One advantage of using coiled tubing is that the tubing is easily run and pulled from a wellbore. Furthermore, coiled tubing may be able to traverse non-linear paths. However, because of the flexibility of the coiled tubing, it is difficult to rotate the tubing to activate a weight-set packer.

Therefore, there is a need for an improved packer which does not utilize rotation to set the packer.

SUMMARY OF THE INVENTION

The present invention relates to packers adapted to seal an annular space within a wellbore. The packers, for example, may be utilized to circulate or reverse circulate a fluid. In one embodiment, the present apparatus comprises a first tubular subunit and a second tubular subunit moveably coupled together, a flexible packing element disposed between the first tubular subunit and the second tubular subunit, and a temporary mechanical connection adapted to restrain the first tubular subunit and the second tubular subunit from compressing the flexible packing element, in which the temporary mechanical connection is adapted to be hydraulically disengaged. In another embodiment, the present apparatus further comprises a valve. In one aspect, the present apparatus further comprises a cement inflation tool. In still another embodiment, the present method comprises locating an apparatus, comprising a packer and a valve positioned above the packer, at a predetermined location within the wellbore; setting the packer, the method of setting the packer comprising, applying a first hydraulic pressure within a central bore of the apparatus and applying down weight on the apparatus; and opening the valve. In one embodiment, the present method comprises actuating a displacement device to displace a fluid below a packer; setting the packer by utilizing a predetermined fluid pressure to disengage a temporary mechanical connection between a first surface and a second surface of the packer and by compressing a packing element between the first surface and second surface; and opening a valve above the packer.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIG. 3 is a partial section view of a locator fastener mated with a profile.

FIG. 4 is an enlarged partial section view of a locator fastener mated with a profile.

FIGS. 5–8 are enlarged partial section views illustrating the operation of one embodiment of setting a packer of the present invention.

DETAILED DESCRIPTION OF THE PREFERRED EMBODIMENT

Figure 1:
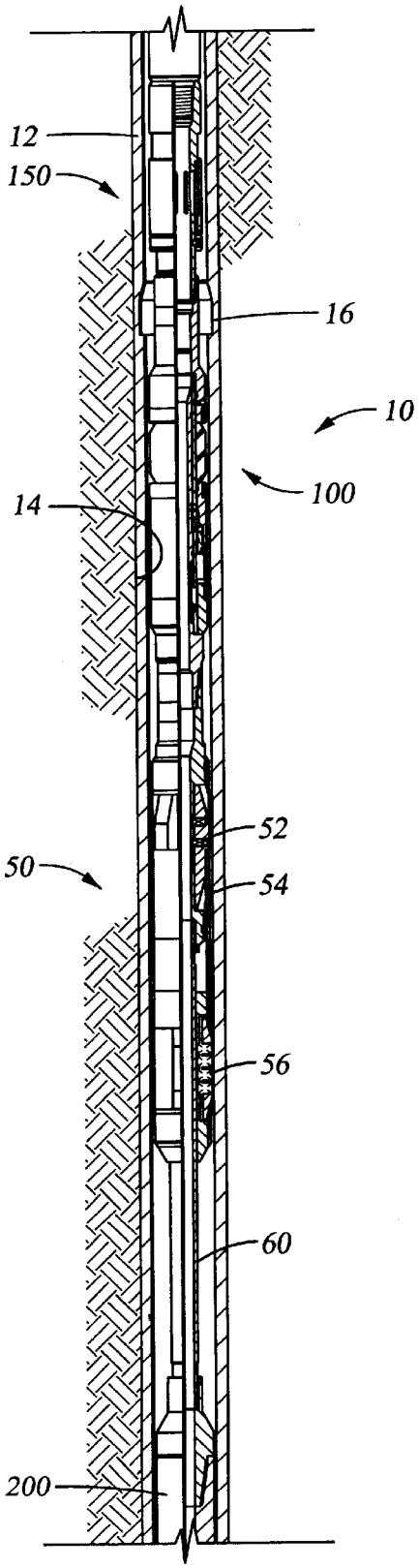
FIG. 1 is a partial section view of one embodiment of an apparatus of the present invention disposed in a wellbore with casing therein.

FIG. 1 is a partial section view of one embodiment of an apparatus 10 of the present invention disposed in a wellbore 14 with casing therein 12. Generally, the apparatus includes a circulating valve 150, a packer 100, and a locator 50. For ease and clarity of illustration and description, the apparatus 10 will be further described in more detail as if disposed in a vertical position in the wellbore 14. It is to be understood, however, that the apparatus 10 may be disposed in any orientation, whether vertical or horizontal. Furthermore, the apparatus 10 may be disposed in any tubular structure, such as within a first tubular inside a second tubular or within a wellbore without a casing there-around. Typically the apparatus is run into a casing on a string of tubulars and includes at an upper end a connection means.

In the embodiment shown in FIG. 1, of the present apparatus, the apparatus includes a locator 50, which braces or fixes the apparatus 10 against downward weight. FIG. 1 shows one embodiment of a locator, although other embodiments of a locator, which allow weight to be set down on the apparatus, are also contemplated such as a packer setting tool, a packer actuator, or a collet locator, etc. As shown in FIG. 1, the locator 50 comprises a locator fastener 52 which is adapted to mate with and support weight against a profile 16 formed on the inner wall of the casing 12 at a predetermined location. A locator fastener retainer 54 is coupled to a drag block 56 adapted to slide along spacer tube 60. The locator fastener retainer 54 is adapted to act as a covering to protect the locator fastener 52 and to prevent the locator fastener 52 from mating with the profile at run-in but is adapted to permit mating with the profile 16 at a predetermined depth.

Figure 2:
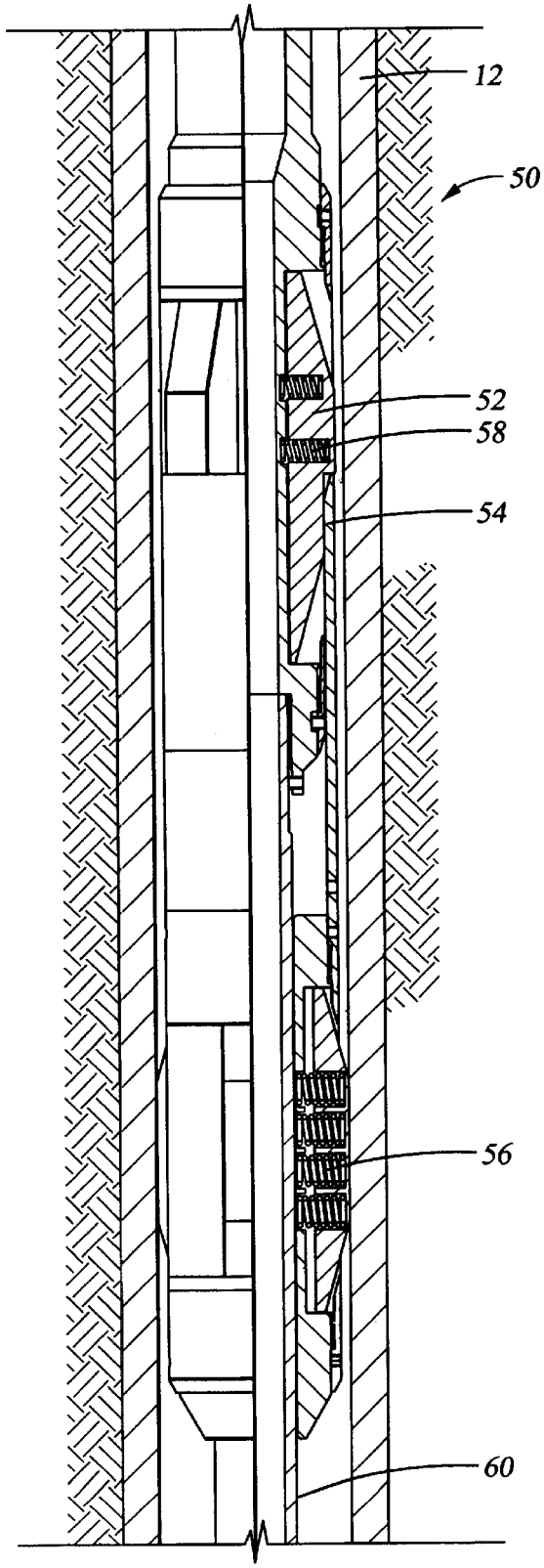
FIG. 2 is an enlarged partial section view of a locator with a locator fastener protected by a locator fastener retainer.

FIG. 2 is an enlarged partial section view of the locator 50 with the locator fastener 52 protected by the locator fastener retainer 54. The locator fastener 52 includes at least one locator fastener spring 58 to bias the locator fastener 52 outward. The locator fastener retainer 54 covers or abuts a surface of the locator fastener 52 to prevent the locator fastener 52 from expanding outward. The locator 50 may be activated by removing the locator fastener retainer 54 from the locator fastener 52 and may be deactivated by replacing the locator fastener retainer 54 over the locator fastener 52. Because the drag block 56 is adapted to contact the casing 12, the locator fastener 52 can be exposed when the apparatus is pulled upward. When the apparatus 10 is pulled up, the frictional force of the drag block 56 against the casing 12 causes the drag block 56 to move down relative to the apparatus 10 and to slide along the spacer tube 60. The apparatus 10 may be moved up and down until the locator fastener 52 mates with the profile 16 arriving at the position shown in FIGS. 3 and 4.

Figure 3:
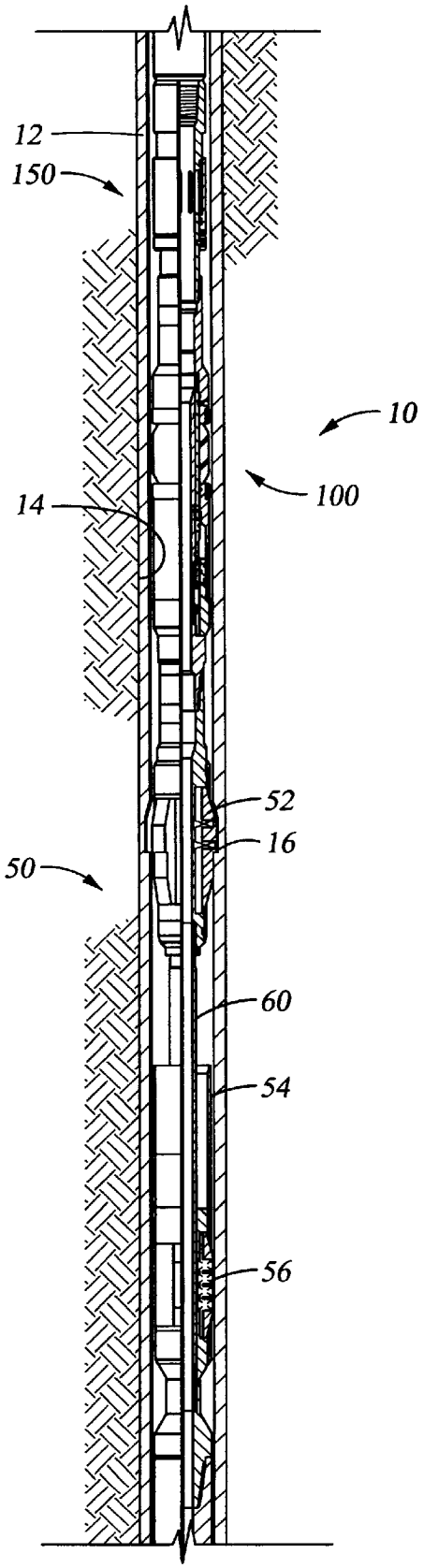
FIG. 3 is a partial section view and FIG. 4 is an enlarged partial section view of the locator fastener mated with a profile.
Figure 4:
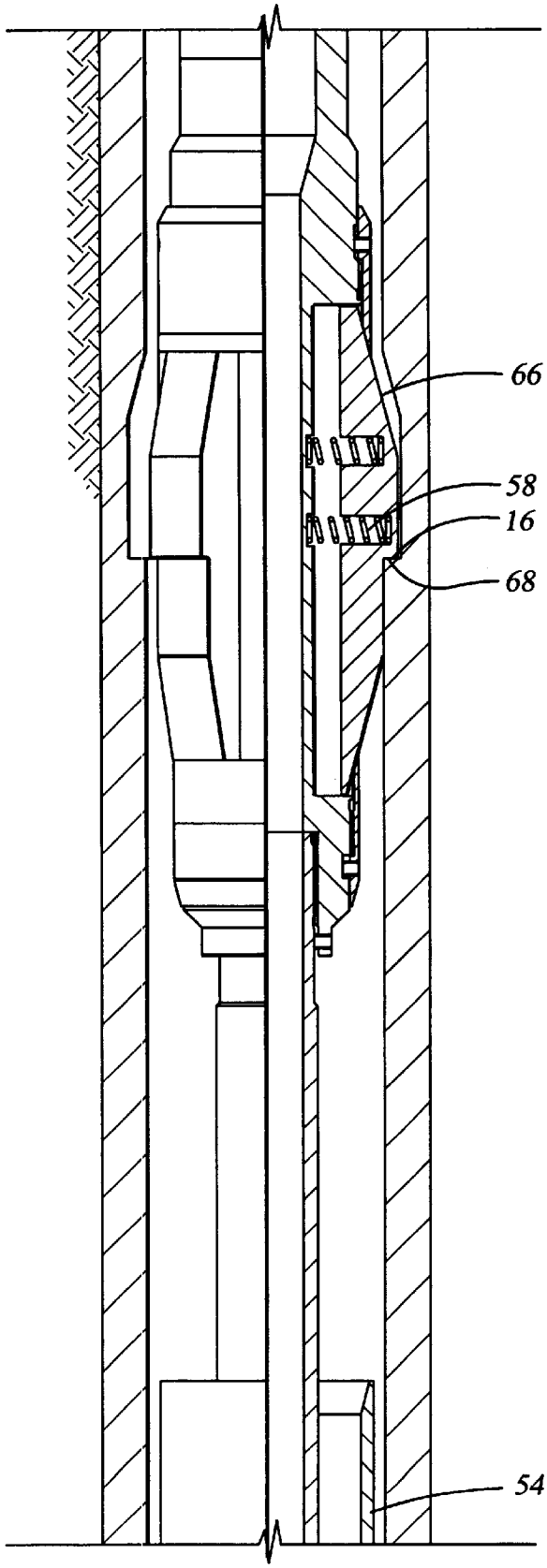

FIG. 3 is a partial section view and FIG. 4 is an enlarged partial section view of the locator fastener 52 mated with the profile 16. Because the locator fastener retainer 54 is no longer abutting the locator fastener 52, the locator fastener spring 58 causes the locator fastener 52 to expand radially. In one embodiment, the locator fastener 52 includes a shoulder formed at a bottom surface 68 to prevent downward movement of the apparatus 10 after contact of the locator fastener 52 with the casing profile 16. In another embodiment, the locator fastener 52 includes a sloped upper surface 66 to allow the locator 50 to be disengaged from the profile 16 by moving the locator upwards and out of the profile 16. Furthermore, the apparatus 10 may be re-located at a second profile higher within the casing than the first profile 16.

In addition, the locator 50 may be adapted to allow the apparatus 10 to be run down into the casing after the locator 50 has been disengaged from the profile 16. For example, the apparatus 10 may be moved upwards to a position where the locator fastener 52 is disengaged from the profile 16 and where the locator fastener retainer 54 is positioned at least partially above the profile 16. Then, the apparatus 10 is moved downward which causes the locator fastener retainer 54 to move upward in relation to the locator fastener 52 as a result of the drag block 56 coupled to the locator fastener retainer 54. The apparatus 10 is moved downward until the locator fastener retainer 54 covers the locator fastener 52 and prevents the locator fastener 52 from mating with the profile 16. Thus, the apparatus 10 can be run down into the casing and through the profile 16. Furthermore, the apparatus may be re-located at a third profile lower within the casing than the first profile 16.

Figure 5:
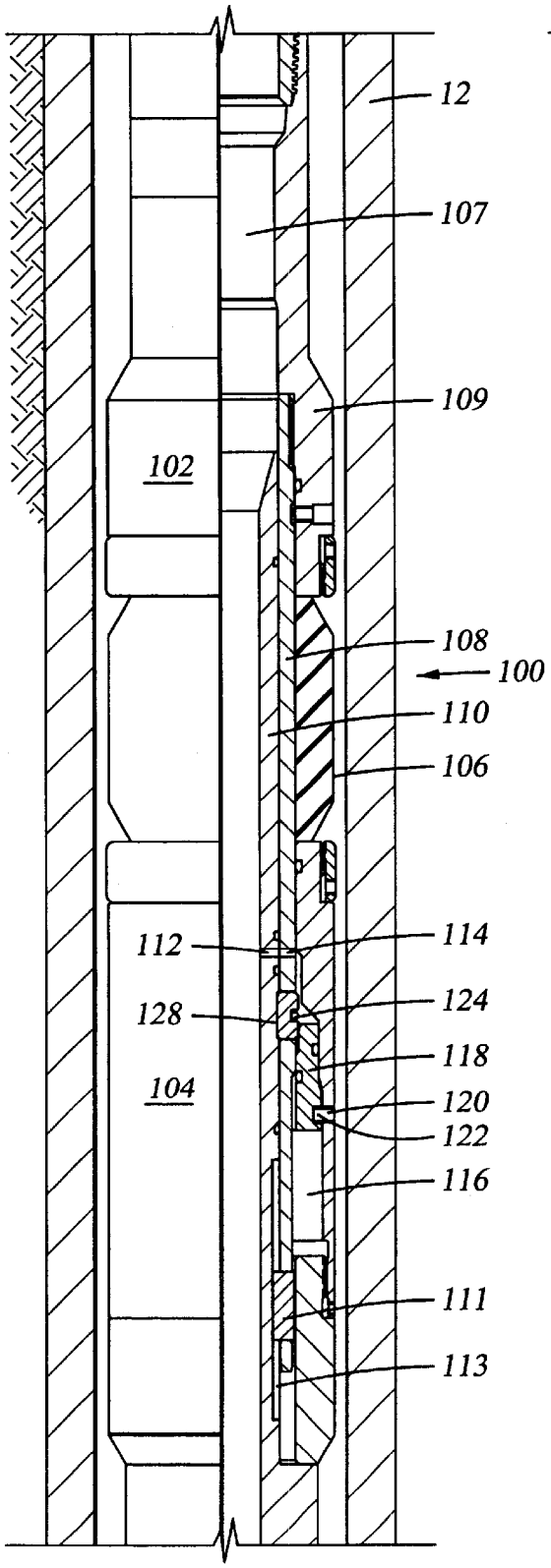
FIG. 5 is an enlarged partial section view illustrating one embodiment of a packer of the present invention.

FIG. 5 is an enlarged partial section view illustrating one embodiment of the packer 100 of the present invention. The apparatus includes a packer 100 comprising a top subunit 102, a bottom subunit 104, and a flexible packing element 106 disposed between the top subunit 102 and the bottom subunit 104. The top subunit 102 is disposed adjacent a first end of the flexible packing element 106 and the bottom subunit 104 is disposed adjacent a second end of the flexible packing element 106. The top subunit 102, the bottom subunit 104, and the flexible packing element 106 each are generally tubular members having a central bore 107 adapted to allow passage of a fluid therethrough.

The top subunit 102 and the bottom subunit 104 are movably coupled together to permit the flexible packing element 106 to be selectively compressed or uncompressed therebetween. When the flexible packing element 106 is compressed, the packing element 106 expands radially outward to contact the casing and to seal the annular space between the casing 12 and the apparatus 10. A temporary mechanical connection is adapted to restrain the top subunit 102 and the bottom subunit 104 from compressing the flexible packing element. In one embodiment, when the packer is to be set, a hydraulic pressure is utilized to disengage the temporary mechanical connection and allow the top subunit 102 and the bottom subunit 104 to compress the flexible packing element 106 therebetween.

The flexible packing element 106 may have any number of configurations to effectively seal the annular space between the apparatus 10 and a casing 12 or tubular there-around. For example, the packing element may include grooves, ridges, indentations, or protrusion designed to allow the packing element 106 to conform to variations in the shape or the interior of the tubular. The packing element 106 may be constructed of any expandable or otherwise malleable material. For example, the packing element may be a metal, a plastic, an elastomer, or a combination thereof.

As illustrated in FIG. 5, the packer top subunit 102 includes a sleeve 108 extending therefrom. Preferably, the sleeve 108 is threadingly connected to the top subunit 102, but may also be connected by other connection devices. The bottom subunit 104 is slidably related to the sleeve 108 permitting the top and bottom subunits to move toward each other and compress the packing element 106. The sleeve 108 is fixed in a housing 109 of the top subunit 102 and is moveably coupled over a body 110 of the bottom subunit 104 by a sliding key 111 disposed in a slot 113 on the bottom subunit 104. The sliding key 111 may also be adapted to allow torque to be transmitted between the top subunit 102 and the bottom subunit 102. Of course, in other embodiments, the sleeve may be fixed in a housing on the bottom unit while the sleeve is moveably coupled over a body of the top subunit.

In one embodiment, a packer fastener 124 acts as a temporary mechanical connection restraining the top subunit 102 and the bottom subunit 104 from compressing the flexible packing element 106. Specifically, in the run in position shown in FIG. 5, the packer fastener 124 rests in a groove 128 formed in the outer surface of the body 110 of the bottom subunit 104, preventing axial movement of the sleeve 108. A piston 118, housed in a piston housing 116 disposed over the sleeve 108 and over the body 110 of the bottom sub 104, holds the packer fastener 124 in the groove 128. A shear pin 120 disposed in a shear pin recess 122 holds the piston 118 in place in the piston housing 116. Instead of a shear pin, any frangible member may be used. The packer fastener 124 also allows weight to be set down on the tool during run in of the apparatus 10 into the well without activating the packer 100.

Figure 6:
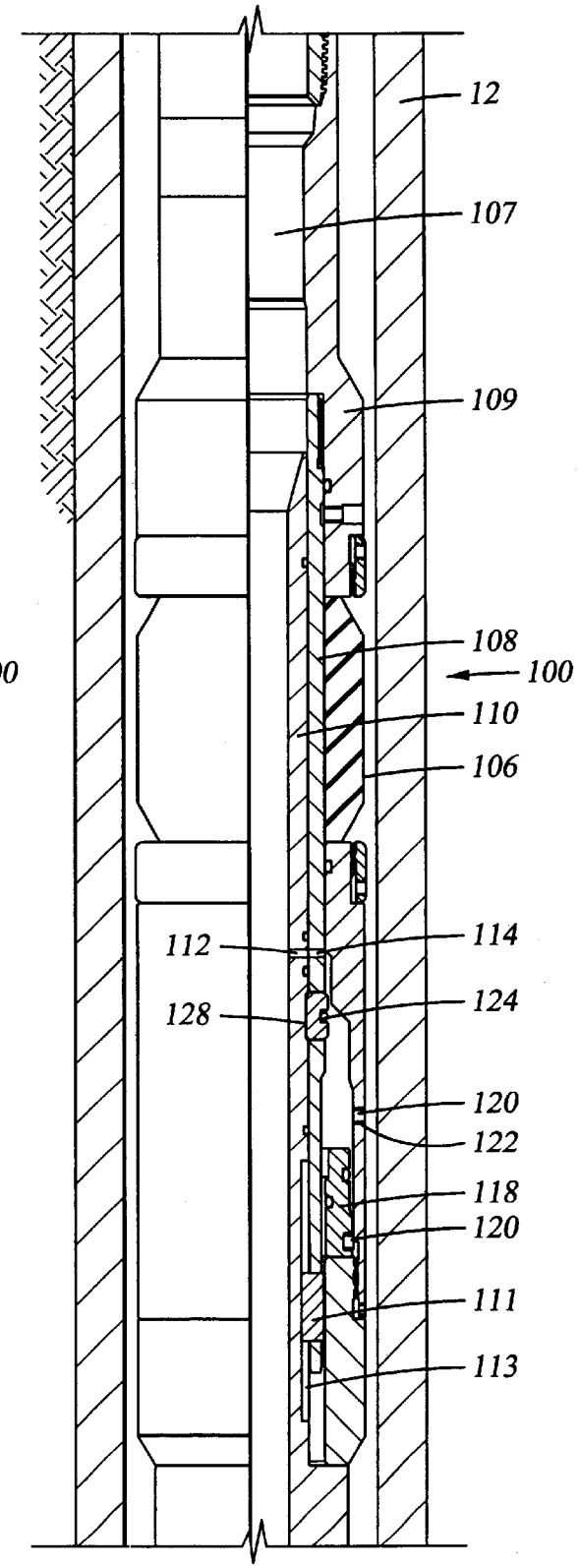
Figure 7:
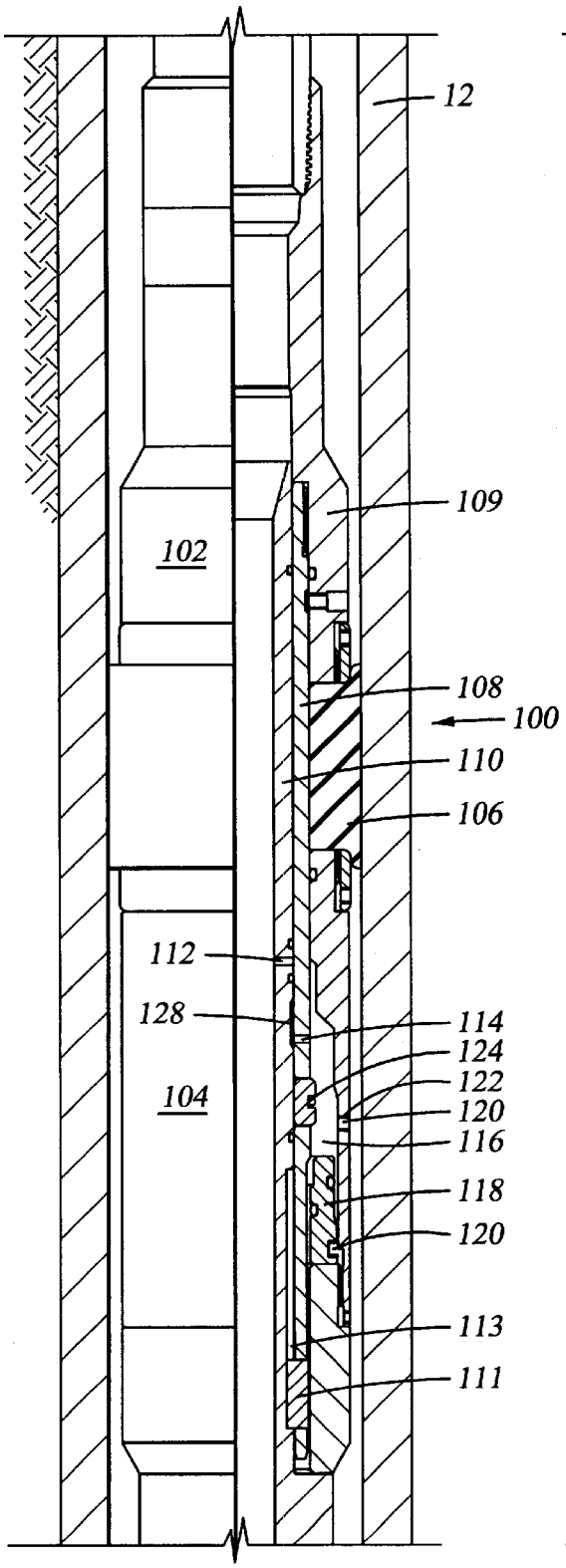
Figure 8:
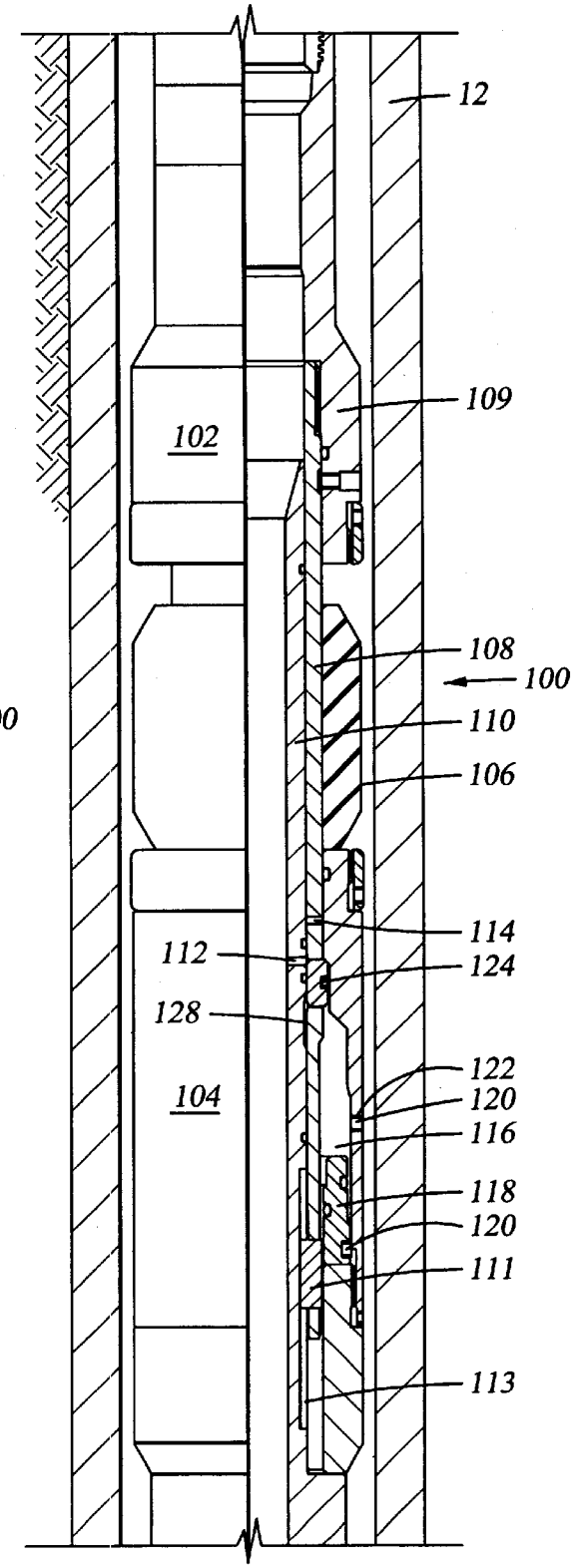

FIGS. 5–8 are enlarged partial section views illustrating the operation of one embodiment of setting the packer 100 of the present invention. To set the packer 100, the apparatus 10 is located at a predetermined position in the wellbore and braced or fixed against downward weight. As shown in FIG. 5, an aperture 112 through the body 110 of the bottom subunit 104 and an aperture 114 through the sleeve 108 are initially in communication allowing fluid to flow into the piston housing 116. As shown in FIG. 6, the pressure of the fluid disposed in the central bore 107 may be increased until it pushes the piston 118 to shear the shear pin 120. Once the shear pin 120 is sheared, it releases the piston 118 which is free to move down the piston housing 116. As shown in FIG. 7, when the piston 118 moves down the piston housing 116, piston 118 no longer retains the packer fastener 124 in the groove 128. Thus, the packer fastener 124 is released and allows sleeve 108 to move. With the packer fastener 124 released, setting down weight on the tubing string compresses the packing element 106 which expands to contact the casing and to act as a seal of the annular space between the casing 12 and the apparatus 10. Furthermore, since the sleeve 108 has slid down, the apertures 112, 114 are no longer in communication and no longer allow fluid to flow through the tubing's inner diameter into the piston housing 116. As shown in FIG. 8, to disengage the packer, set down weight on the apparatus 10 is released which causes the packing element 106 to return to its original position. Thus, the packer 100 may be disengaged by pulling the apparatus 10 out of the wellbore.

In addition, the piston housing 116 and/or apertures 112,114 may contain grease therein to prevent clogging of the piston housing from particulate matter which may be contained in the fluid being passed through the central bore. Furthermore, the packer 100 may include O-rings (not shown) disposed in O-ring recesses to prevent leaks. For example, O-rings may be disposed in an O-ring recess in the body on both side of the aperture 112; an O-ring may be disposed between the top subunit 102 or bottom subunit 104 and the sleeve 108; an O-ring may be disposed in an O-ring recess in the piston 118, an O-ring may be disposed between the body 110 and the sleeve 108, etc.

Figure 9:
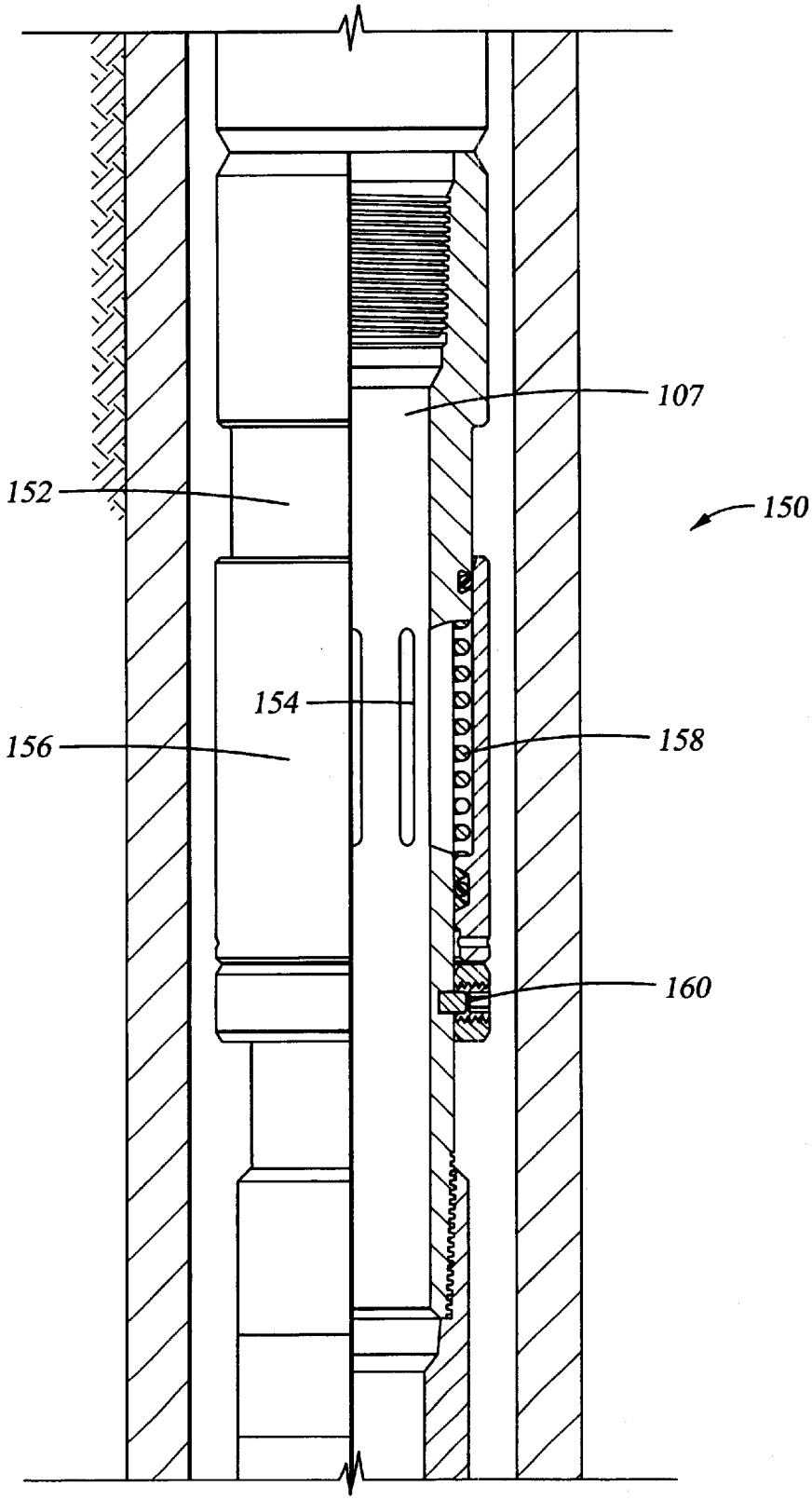
FIG. 9 is a section view of one embodiment of a valve of the present apparatus.

In one embodiment, the packer 100 of the present apparatus is used in conjunction with a valve located on the apparatus 10 above the packer 100. The valve may be selectively opened to allow fluid to flow between the annular space and the central bore of the valve. FIG. 9 is a section view of one embodiment of a valve of the present apparatus. The valve 150 comprises a annular body 152 having a central bore 107 therethrough. Holes 154 in the annular body 152 allow fluid to flow between the annular space and the central bore 107 of the valve 150. A moveable sleeve 156 covers the holes 154 and prevents the flow of fluid through the holes 154. The valve further includes a device to selectively open the valve 150. In one embodiment, the device comprises a spring 158 coupled to the sleeve 156 and adapted to bias the sleeve 156 to slide or rotate to expose the holes 154. A temporary mechanical connection prevents the sleeve 156 from moving. In one embodiment, the temporary mechanical connection is adapted to be disengaged by a hydraulic pressure higher than the hydraulic pressure required to disengage the mechanical connection preventing the setting of packer 100. In one embodiment, the temporary mechanical connection of the valve 150 is a shear pin 160, although any frangible member may be used. In other embodiments, the valve may be opened by manipulating the tubing string. For example, the valve may be opened by manipulating the tubing string axially or by torsion.

In another embodiment, the present apparatus and method comprises utilizing a circulating/reverse circulating packer with a second tool 200 which is activated prior to the present packer. One example of a second tool 200 is a SCIT cement inflation tool described in U.S. Pat. No. 5,615,741 which is hereby incorporated by reference in its entirety. The cement inflation tool 200 is located below the circulating/reverse circulating packer and is used to inflate a packer at the casing walls with cement. It is difficult to determine the exact amount of cement required to inflate the cement inflation packer 200. As a consequence, an over abundance of cement must be used to inflate the cement inflation packer 200, causing cement to remain in the tubing string once the inflation of cement is complete. Therefore the present packer may be used to circulate or reverse circulate the cement from the tubing string.

In still another embodiment, the method of the present invention comprises locating the apparatus 10 by use of a locator 50 at a predetermined location within the wellbore, setting the packer 100, and opening the valve 150. Since the packer 100 is adapted to seal the annular space between the casing and the packer 100, a first fluid may be circulated out of the wellbore by flowing in a second fluid down the central bore 107, through the valve 150, and up the annular space between the casing and the tubing or a first fluid may be reversed circulated out of the wellbore by flowing in a second fluid down the annular space between the casing and the tubing, through the valve 150, and up the central bore 107. The second fluid, used to circulate or reverse circulate a first fluid out of the wellbore, may be any liquid or gas.

For example, the first fluid may be a cement slurry which would be undesirable to let fall to the bottom of a wellbore (i.e., the cement may plug screens located in the casing). Therefore, the packer 100 may be set and a second fluid comprises a clean fluid may be used to circulate or reverse circulate the cement out of the tubing string. Then, when pulling the tubing string from the wellbore, a valve may be opened to allow the clean fluid to fall to the bottom of the wellbore In one embodiment, the present packer is adapted to remain unactivated while the displacement of fluid below the packer is complete. The fluid may be any liquid or slurry, such as cement, acid, or particulate matter. The packer then may be activated to pack off or seal the annular space between a casing and a tubing string when the displacement of fluid below the packer is complete. The packer is adapted to remain set while the fluid is circulated or reversed circulated through a valve located above the packer. The packer is further adapted to release and be pulled out of the well.

In another embodiment, the present apparatus and method comprises utilizing a circulating/reverse circulating packer with a second tool which is activated prior to the present packer. One example of a second tool is a SCIT cement inflation tool described in U.S. Pat. No. 5,615,741 which is hereby incorporated by reference in its entirety. The cement inflation tool is located below the circulating/reverse circulating packer and is used to inflate a packer at the casing walls with cement. It is difficult to determine the exact amount of cement required to inflate the cement inflation packer. As a consequence, an over abundance of cement must be used to inflate the cement inflation packer causing cement to remain in the tubing string once the inflation of cement is complete. Therefore, the present packer may be used to circulate or reverse circulate the cement from the tubing string.

While foregoing is directed to preferred embodiments of the present invention, other and further embodiments of the invention may be devised without departing from the basic scope thereof, and the scope thereof is determined by the claims that follow. Furthermore, it is understood that the quantity of all the elements of the apparatus and method of the present invention may be one or more in number.

What is claimed is:

1. A packer for sealing an annular space in a wellbore, the wellbore having a string of casing therein, the packer comprising:

a first tubular subunit;

a second tubular subunit;

an inner sleeve operatively connected to the second subunit, and slideably received within the first subunit;

a flexible packing element disposed between the first subunit and the second subunit, and arranged such that mechanical compression of the first subunit towards the second subunit extrudes the flexible packing element into sealed radial engagement with the surrounding casing; and a releasable mechanical connection adapted to restrain the first subunit and the second subunit from compressing the flexible packing element until the releasable mechanical connection is released, wherein the temporary mechanical connection is hydraulically released before the flexible packing element is extruded.

2. The packer of claim 1, wherein the flexible packing element comprises a first end disposed adjacent the first subunit, and a second end disposed adjacent the second subunit.

3. The packer of claim 2, further comprising a frangible member preventing release of the temporary mechanical connection.

4. The packer of claim 2, wherein the temporary mechanical connection comprises a fastener releasably held by a piston releasably held in a piston housing by a frangible member.

5. The packer of claim 4, wherein the frangible member comprises a shear pin.

6. The packer of claim 5, wherein the piston is adapted to shear the shear pin when a predetermined hydraulic pressure is applied to the piston.

7. The packer of claim 2, further comprising an aperture permitting fluid flow between a central bore of the packer and a housing, the aperture being selectively positioned between an open position and a closed position, wherein when the aperture is in the open position a fluid is permitted to flow into the housing to disengage the temporary mechanical connection.

8. The packer of claims 7, wherein when the aperture is in the closed position the fluid is not permitted to flow into the housing.

9. The packer of claim 2, wherein when the temporary mechanical connection is disengaged, the first tubular subunit and the second tubular subunit is adapted to compress the flexible packing element, whereby the flexible packing element expands to seal the annular space.

10. The packer of claim 2, wherein the first tubular subunit and the second tubular subunit are coupled together to allow torque to be transmitted therebetween.

11. A packer for sealing an annular space in a wellbore, the wellbore having a string of casing therein, the packer comprising:

a first tubular subunit;

a second tubular subunit;

an inner sleeve operatively connected to the second subunit, and slidably received within the first subunit;

a flexible packing element disposed between the first subunit and the second subunit, and arranged such that mechanical compression of the first subunit towards the second subunit extrudes the flexible packing element into sealed radial engagement with the surrounding casing; and a releasable mechanical connection adapted to restrain the first subunit and the second subunit from compressing the flexible packing element until the releasable mechanical connection is released, wherein the temporary mechanical connection is hydraulically released before the flexible packing element is extruded.

12. The apparatus of claim 11, wherein the temporary mechanical connection is hydraulically disengaged by a first pressure, and wherein the valve is hydraulically opened by a second pressure higher than the first pressure.

13. The apparatus of claim 12, further comprising:

a locator selectively fixable against downward weight within the casing at a predetermined location.

14. The apparatus of claim 13, wherein the locator is disposed below the packer.

15. The apparatus of claim 13, further comprising:

a cement inflation tool.

16. A packer for sealing an annular space, comprising:

a first tubular subunit and a second tubular subunit moveably coupled together;

a flexible packing element disposed between the first tubular subunit and the second tubular subunit, wherein the first tubular subunit is disposed adjacent a first end of the packing element and wherein the second tubular subunit is disposed adjacent a second end of the packing element;

a temporary mechanical connection adapted to restrain the first tubular subunit and the second tubular subunit from compressing the flexible packing element, wherein the temporary mechanical connection is adapted to be hydraulically disengaged; and an aperture, between a central bore of the packer and a housing, adapted to be selectively positioned between an open position and a closed position, wherein when the aperture is in the open position a fluid is permitted to flow into the housing to disengage the temporary mechanical connection, and wherein when the aperture is in the closed position and the packing element is compressed, the fluid is not permitted to flow into the housing.

17. The packer of claim 16, further comprising a sliding key moveably coupling the first tubular subunit and the second tubular subunit together and allowing torque to be transmitted therebetween.

18. An apparatus for use in wellbore operations, comprising:

a valve; and a packer disposed below the valve, wherein the packer comprises:

a first tubular subunit and a second tubular subunit moveably coupled together;

a flexible packing element disposed between the first tubular subunit and the second tubular subunit, wherein the first tubular subunit has a surface disposed adjacent a first end of the packing element and wherein the second tubular subunit has a surface disposed adjacent a second end of the packing element;

a temporary mechanical connection adapted to restrain the first tubular subunit and the second tubular subunit from compressing the flexible packing element, wherein the temporary mechanical connection is adapted to be hydraulically disengaged; and a locator selectively fixable against downward weight within the well at a predetermined location, wherein the locator is adapted to be activated by removing a covering.

19. A method of operating an apparatus disposed on a tubular string in a wellbore to remove a fluid from the tubular string, the wellbore having a string of casing therein, the method comprising the steps of:

locating the apparatus, comprising a packer and a valve positioned above the packer, at a predetermined location within the wellbore;

setting the packer, the method of setting the packer comprising:

applying a first hydraulic pressure within a central bore of the apparatus; and applying down weight on the apparatus; and opening the valve.

20. The method of claim 19, wherein applying the first hydraulic pressure within the central bore of the apparatus comprises increasing a pressure within the tubular string to disengage a frangible connection.

21. The method of claim 20, wherein the frangible connection is a shear pin.

22. The method of claim 19, wherein opening the valve comprises applying a second hydraulic pressure higher than the first hydraulic pressure within the central bore of the apparatus.

23. The method of claim 22, wherein applying the second hydraulic pressure comprises increasing a pressure within the tubular string above the first hydraulic pressure to disengage a second frangible member.

24. The method of claim 23, wherein the second frangible member is a second shear pin.

25. The method of claim 19, wherein opening the valve comprises manipulating the tubing string.

26. The method of claim 25, wherein manipulating the tubing string comprises manipulating the tubing string in an axial direction.

27. The method of claim 25, wherein manipulating the tubing string comprises manipulating the tubing string by torsion.

28. The method of claim 19, wherein locating the apparatus comprises positioning the apparatus to resist downward weight.

29. The method of claim 28, wherein locating the apparatus comprises fixing the apparatus at the predetermined location within the wellbore on a profile formed on the inside of the casing.

30. The method of claim 19, wherein applying the first hydraulic pressure comprises providing a predetermined pressure to disengage a temporary mechanical connection restraining compression of a flexible packing element of the packer.

31. The method of claim 30, wherein applying the first hydraulic pressure comprises providing a predetermined pressure to disengage a frangible member releasably holding a temporary mechanical connection restraining compression of a flexible packing element of the packer.

32. The method of claim 31, wherein the frangible member is a shear pin.

33. The method of claim 19, further comprising circulating the fluid through the valve.

34. The method of claim 19, further comprising reverse circulating the fluid through the valve.

35. The method of claim 19, further comprising re-locating the apparatus.

36. A method of operating an apparatus, the apparatus comprising a packer, a valve positioned above the packer, and a cement inflation tool below the packer, the apparatus being run into a wellbore on a working string, the method comprising:

actuating the cement inflation tool in connection with a wellbore cementing operation;

setting the packer by utilizing a predetermined fluid pressure to disengage a temporary mechanical connection between a first surface and a second surface of the packer, and by compressing a packing element between the first surface and second surface by application of mechanical compressive force directed through the working string;

opening the valve; and circulating a fluid through the valve.

37. The method of claim 36, wherein the fluid is selected from the group consisting of cement, acid, and a slurry of particulate matter.

38. The method of claim 36, further comprising circulating the fluid through the valve.

39. The method of claim 36, further comprising reverse circulating the fluid through the valve.

40. The method of claim 36, wherein utilizing the predetermined fluid pressure to disengage the temporary mechanical connection comprises increasing fluid pressure within the working string of the apparatus.

41. The method of claim 40, wherein opening the valve also comprises increasing the pressure within the working string of the apparatus above the predetermined pressure.

42. The method of claim 36, wherein opening the valve comprises manipulating the working string.

43. The method of claim 42, wherein manipulating the working string comprises manipulating the working string in an axial direction.

44. The method of claim 43, wherein manipulating the working string comprises manipulating the working string by torsion.

* * * * *